US007674970B2

(12) United States Patent
Ma et al.

(10) Patent No.: US 7,674,970 B2
(45) Date of Patent: Mar. 9, 2010

(54) MULTIFUNCTIONAL DIGITAL MUSIC DISPLAY DEVICE

(76) Inventors: Brian Siu-Fung Ma, 10111 Westminster Ct., Cupertino, CA (US) 95014; Kenneth Chi-Kit Ma, 10111 Westminster Ct., Cupertino, CA (US) 95014

( * ) Notice: Subject to any disclaimer, the term of this patent is extended or adjusted under 35 U.S.C. 154(b) by 0 days.

(21) Appl. No.: 11/750,088

(22) Filed: May 17, 2007

(65) Prior Publication Data

US 2008/0282872 A1 Nov. 20, 2008

(51) Int. Cl.
*G10H 1/02* (2006.01)

(52) U.S. Cl. ..... 84/627; 84/470 R; 84/471 R; 84/477 R; 84/478; 84/483.1; 84/603; 84/609; 84/663; 84/702; 84/738

(58) Field of Classification Search ..... 84/470 R, 84/471 R, 477 R, 478, 483.1, 603, 609, 627, 84/663, 702, 738
See application file for complete search history.

(56) References Cited

U.S. PATENT DOCUMENTS

| | | | | |
|---|---|---|---|---|
| 4,524,668 | A * | 6/1985 | Tomisawa et al. | 84/627 |
| 4,638,709 | A * | 1/1987 | Nagashima et al. | 84/607 |
| 4,815,352 | A * | 3/1989 | Tsukamoto et al. | 84/617 |
| 5,005,459 | A * | 4/1991 | Adachi et al. | 84/453 |
| 5,430,241 | A * | 7/1995 | Furuhashi et al. | 84/603 |
| 5,536,902 | A * | 7/1996 | Serra et al. | 84/623 |
| 5,587,541 | A * | 12/1996 | McIntosh et al. | 84/297 S |
| 6,096,960 | A * | 8/2000 | Scott | 84/603 |
| 6,124,544 | A * | 9/2000 | Alexander et al. | 84/616 |
| 6,392,135 | B1 * | 5/2002 | Kitayama | 84/622 |
| 6,751,439 | B2 * | 6/2004 | Tice et al. | 434/350 |
| 6,798,886 | B1 * | 9/2004 | Smith et al. | 381/61 |
| 7,117,154 | B2 * | 10/2006 | Yoshioka et al. | 704/258 |
| 7,145,068 | B2 * | 12/2006 | Mizuno | 84/477 R |
| 7,375,273 | B2 * | 5/2008 | Sawyer-Kovelman et al. | 84/609 |
| 7,482,529 | B1 * | 1/2009 | Flamini et al. | 84/645 |

(Continued)

OTHER PUBLICATIONS

Chopin, Frederic, "Fantasie-Impromptu in C# minor", 2004, 20 pages, ELF publications, SibeliusMusic, http://www.sibeliusmusic.com/cgi-bin/show_score.pl?scoreid=52700.

(Continued)

*Primary Examiner*—Walter Benson
*Assistant Examiner*—Kawing Chan
(74) *Attorney, Agent, or Firm*—McAndrews, Held & Malloy, Ltd.

(57) ABSTRACT

Herein described are at least a method and a system for assisting a musician in playing an instrument by way of using an intelligent multifunctional digital music display device (MDMDD). The multifunctional digital music display device (MDMDD) may be used to assist musicians or performers during practice sessions or performances. The various aspects of the invention provide a method of constructing an ADSR envelope for a note generated by an instrument, displaying one or more pages of music, generating a more accurate metronome beat consistent with the music being played, and alerting the musician when his instrument is out-of-tune. Further, the various aspects of the invention provide a method of statistically monitoring and reporting the performance of the musician. The system comprises a storage device capable of storing an instructional code, a processor for executing the instructional code, a microphone, and a display.

14 Claims, 9 Drawing Sheets

U.S. PATENT DOCUMENTS

| | | | | |
|---|---|---|---|---|
| 2003/0005814 | A1* | 1/2003 | Matsumoto | 84/477 R |
| 2003/0110926 | A1* | 6/2003 | Sitrick et al. | 84/477 R |
| 2004/0025676 | A1* | 2/2004 | Shadd | 84/743 |
| 2004/0055441 | A1* | 3/2004 | Katsuta | 84/470 R |
| 2004/0211309 | A1* | 10/2004 | Hsieh | 84/603 |
| 2005/0081701 | A1* | 4/2005 | Shao | 84/612 |
| 2005/0204903 | A1* | 9/2005 | Lee et al. | 84/645 |
| 2005/0252362 | A1* | 11/2005 | McHale et al. | 84/616 |
| 2006/0181537 | A1* | 8/2006 | Vasan et al. | 345/473 |
| 2006/0196343 | A1* | 9/2006 | Yung | 84/470 R |
| 2007/0089592 | A1* | 4/2007 | Wilson et al. | 84/612 |
| 2007/0163425 | A1* | 7/2007 | Tsui et al. | 84/609 |
| 2008/0078281 | A1* | 4/2008 | Katsuta | 84/609 |
| 2008/0156171 | A1* | 7/2008 | Guldi | 84/466 |

OTHER PUBLICATIONS

Mikulic, Emil, "Windowing and FFTs", 2004, pp. 1-8, Valid XHTML 1.1, http://dmr.ath.cx/sound/window/.

Raskinis, Gailius, "Wav to midi conversion software—Solo Explorer", 2002, pp. 1-3, Recognisoft, http://www.recognisoft.com/cgi-bin/main.cgi?lan=en&id=21.

Wikipedia, "ADSR envelope", Apr. 11, 2007, pp. 1-2, Wikimedia Foundation, Inc., http://en.wikipedia.org/wiki/ADSR.

Wikipedia, "Curve fitting", Apr. 22, 2007, pp. 1-4, Wikimedia Foundation, Inc., http://en.wikipedia.org/wiki/Curve_fitting.

Wikipedia, "Extrapolation", Apr. 28, 2007, pp. 1-3, Wikimedia Foundation, Inc., http://en.wikipedia.org/wiki/Extrapolation.

Wikipedia, "Fast Fourier transform", May 14, 2007, pp. 1-6, Wikimedia Foundation, Inc., http://en.wikipedia.org/wiki/Fast_fourier_transform.

Wikipedia, "Musical Instrument Digital Interface", May 6, 2007, pp. 1-11, Wikimedia Foundation, Inc., http://en.wikipedia.org/wiki/MIDI.

Wikipedia, "Regression analysis", May 14, 2007, pp. 1-7, Wikimedia Foundation, Inc., http://en.wikipedia.org/wiki/Regression_analysis.

Wikipedia, "Synthesizer", May 14, 2007, pp. 1-16, Wikimedia Foundation, Inc., http://en.wikipedia.org/wiki/Synthesizer.

Wikipedia, "Window function", Apr. 6, 2007, pp. 1-8, Wikimedia Foundation, Inc., http://en.wikipedia.org/wiki/Window_function.

* cited by examiner

Resulting ADSR Envelope of Two Slurred Notes
Maximum
1st Note "Key Released"
2nd Note "Key Released"
Maximum
1st Note "Key Pressed"

ADSR Envelope of Two Overlapping Notes: 1st Note's Release Phase Overlaps with 2nd Note's Attack Phase
Maximum
1st Note "Key Released"
2nd Note "Key Released"
Maximum
Extrapolated 2nd Note "Key Pressed"
1st Note "Key Pressed"

MULTIFUNCTIONAL DIGITAL MUSIC DISPLAY DEVICE

BACKGROUND OF THE INVENTION

While performing or practicing, a musician typically refers to sheets or pages of music placed on a music stand. The musician may need to carry one or more sheets or pages of music to a performance or practice session. In either case, carrying a number of sheets, pages, or scores may cause an inconvenience to the musician in a number of ways.

For example, the musician may have to carry a large number of pages when traveling to a particular location. Before playing his instrument, the pages may have to be arranged or organized on a music stand in a suitable order. Furthermore, the condition of such page music may deteriorate over time; and as a result, a musician may be unable to read the pages well.

Furthermore, when a musician performs, he inevitably needs to flip through successive pages. The musician may be interrupted as he flips or turns to a successive page. The musician may also need to determine an appropriate time to flip the page depending on the type of music being played. When the cadence or "beat" of the music is fast, the musician may need to prepare well in advance at what instant he should flip the page, so as to minimize any interruption in his playing. Certainly, the level of inconvenience may be related to the type of instrument being played. It may be extremely difficult for a musician playing a large instrument to reach over and flip a page from a music stand, for example. In the process of flipping a page, a musician may also drop one or more pages on the floor, making it difficult for him to continue playing without stopping.

During a practice session or recital, a musician may need to use a metronome to assist him in maintaining the correct tempo, cadence, or "beat" associated with a musical composition. The metronome may provide an accurate beat over a short period of time for a musical composition. However, in certain musical compositions, the beat may vary from measure to measure. As a result, the use of a metronome may be of little benefit. Also, when a musician recites a musical composition having a rapid tempo, the metronome may not provide accurate references to the notes within each beat or measure.

Further, it may be difficult for a musician, for example, to assess his progress when learning how to play a certain musical composition. Often, progress is ascertained by way of feedback obtained from a music teacher, tutor, or instructor. In certain instances, it may be difficult to meet with the instructor if the instructor and the student live far apart. In other instances, an instructor's assessment of a student's progress may be subjective. Therefore, it may be impossible to quickly and objectively ascertain the student's progress or abilities when a student is learning to play a particular musical composition.

The limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Various aspects of the invention provide at least a method and a system of assisting a musician in playing an instrument by way of using an intelligent multifunctional digital music display device (MDMDD). The various aspects and representative embodiments of the method and the system are substantially shown in and/or described in connection with at least one of the following figures, as set forth more completely in the claims.

These and other advantages, aspects, and novel features of the present invention, as well as details of illustrated embodiments, thereof, will be more fully understood from the following description and drawings.

DETAILED DESCRIPTION OF THE INVENTION

Various aspects of the invention can be found in a method and a system of assisting a musician in playing an instrument by way of using an intelligent multifunctional digital music display device (MDMDD). The multifunctional digital music display device (MDMDD) may be used to assist musicians or performers during practice sessions or performances.

Various aspects of the invention provide a method to generate or construct an ADSR envelope or profile for each note sounded by an instrument. The ADSR envelope may be defined in terms of four phases. The first phase may be described as the "attack" phase, the second phase may be described as the "decay" phase, the third phase may be described as the "sustain" phase, and the fourth phase may be described as the "release" phase. When a musician plays his instrument, the ADSR profile may be determined by way of filtering the fundamental frequency of each of the one or more notes captured by the MDMDD. The fundamental frequency may be monitored or tracked over time such that the ADSR profile is generated. In a representative embodiment, the MDMDD may be used to automatically flip or turn pages of music as a musician plays his instrument. The MDMDD turns pages of music by comparing a data file against the musical notes detected, which relies on construction and recognition of the ADSR profile of each note played by a musician. In a representative embodiment, the MDMDD may act as an "intelligent metronome" by tracking the notes that were played by a musician and correlating this information with a referenced data file within the MDMDD. The data file may comprise a MIDI SMF (Standard MIDI File) file or XMF (eXtensible Music File) file format, for example, that corresponds to the musical piece or composition played by the musician. The MDMDD may store a plurality of such reference compositions for a number of different musical pieces or compositions. When functioning as an intelligent metronome, the MDMDD uses the data file as a reference for comparing the sound (i.e., notes) received from the instrument. The MDMDD may be used to assess a musician's temporal accuracy of each and every note played. In a representative embodiment, the MDMDD may be used to alert and correct an out-of tune instrument. The MDMDD may collect temporal and/or harmonics composition statistics while a musician is playing, and may provide this alert during a performance or provide a report to a user when requested, for example. In a representative embodiment, the MDMDD may be used to detect and perform statistical analysis of one or more musical errors that a musician makes while playing an instrument. The errors comprise tonal and temporal errors that the musician makes during a practice or recital, for example.

Figure 1:
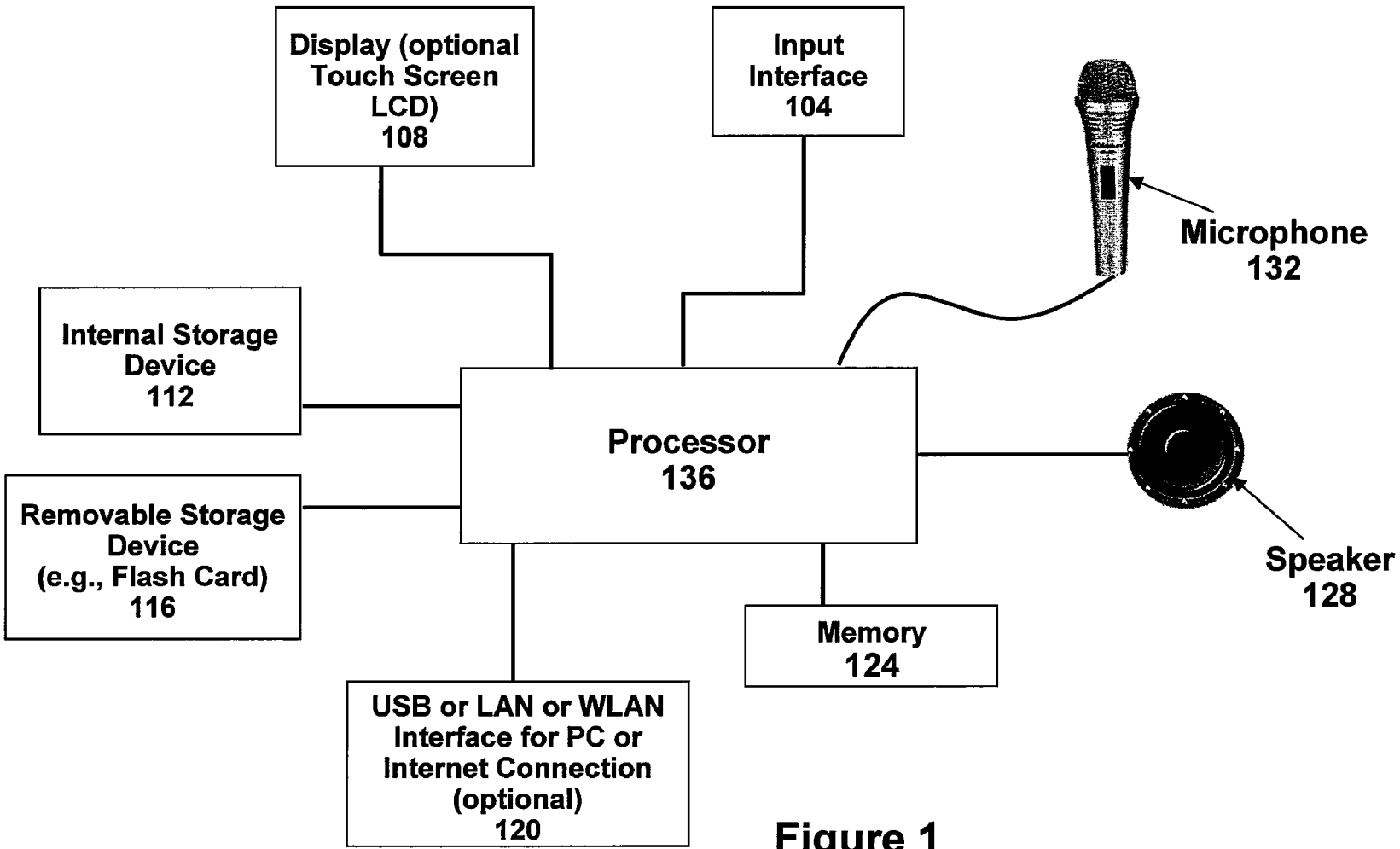
FIG. 1 is a block diagram of a multifunctional digital music display device (MDMDD) in accordance with an embodiment of the invention.

FIG. 1 is a block diagram of a multifunctional digital music display device (MDMDD) in accordance with an embodiment of the invention. The MDMDD comprises an input interface 104, a display 108, an internal storage device 112, a removable storage device 116, a USB/local area network (LAN)/wide area network (WLAN) interface 120, a memory 124, a speaker 128, a microphone 132, and a processor 136. The input interface 104 may comprise a keypad or keyboard by which a user may provide inputs to the MDMDD. The display 108 may comprise a touch screen LCD display allowing a user or musician to provide one or more inputs by touching the screen of the display 108. In addition to displaying one or more pages of music, the display 108 may provide one or more selections to the user. The user may make a selection by way of touching the one or more displayed selections. The display 108, for example, may also provide one or more alerts to a user while the user is playing his instrument. The display 108 may also provide timing and/or tonal information related to how the user is performing while playing his instrument or at a user's request after a performance. The internal storage device 112 may comprise any type of storage drive. For example, the storage drive may comprise any NAND or NOR Flash media, a magnetic hard disk drive, optical drive, or DVD or CD drive. The removable storage device 116 may comprise any type of portable removable memory card, such as any type of flash card. The flash card may comprise a compact flash (CF) card or secure digital (SD) card, for example. The removable storage device 116 may store data files comprising a plurality of sheets/pages of music for a particular musical composition or piece corresponding to an instrument, for example. The data may comprise a MIDI SMF or XMF file, for example. The data files may be referenced by the MDMDD for comparing the notes played by a musician. The data files may comprise music that is transposed and/or formatted for any number of different musical instruments. The removable storage device 116 may store data files comprising any number of pages of one or more musical pieces based on its storage capacity. Similarly, the internal storage device 112 may store data files comprising any number of pages of one or more musical pieces. The internal storage device 112 may function as a backup storage device for the removable storage device 116, should the removable storage device 116 run out of capacity. The USB/LAN/WLAN interface 120 may comprise any type of interface or connector capable of communicatively coupling the MDMDD to a personal computer (PC), a LAN or WLAN network, or the Internet. The memory 124 may comprise any type of memory capable of storing software code and/or processor instructions which may be executed by any type of processor. The memory 124 may also be used to store software code. The speaker 128 may comprise any electrical to acoustical transducer capable of generating an audio sound output to the user. The MDMDD by way of using the speaker 128, for example, may provide an audible output to a user of the notes a particular instrument should generate when a musical piece is played correctly. The speaker 128 may also be used to provide audible messages to a user. The audible messages may comprise one or more alerts or statistical information regarding the number and types of errors, as perceived by the MDMDD. The microphone 132 provides an acoustical to electrical transducer capable of capturing the sounds generated by an instrument. As shown in FIG. 1, the microphone 132 may comprise an on/off switch. The processor 136 may be used to process and execute any type of software code such that one or more algorithms and/or applications may be implemented by the MDMDD.

Figure 2A:
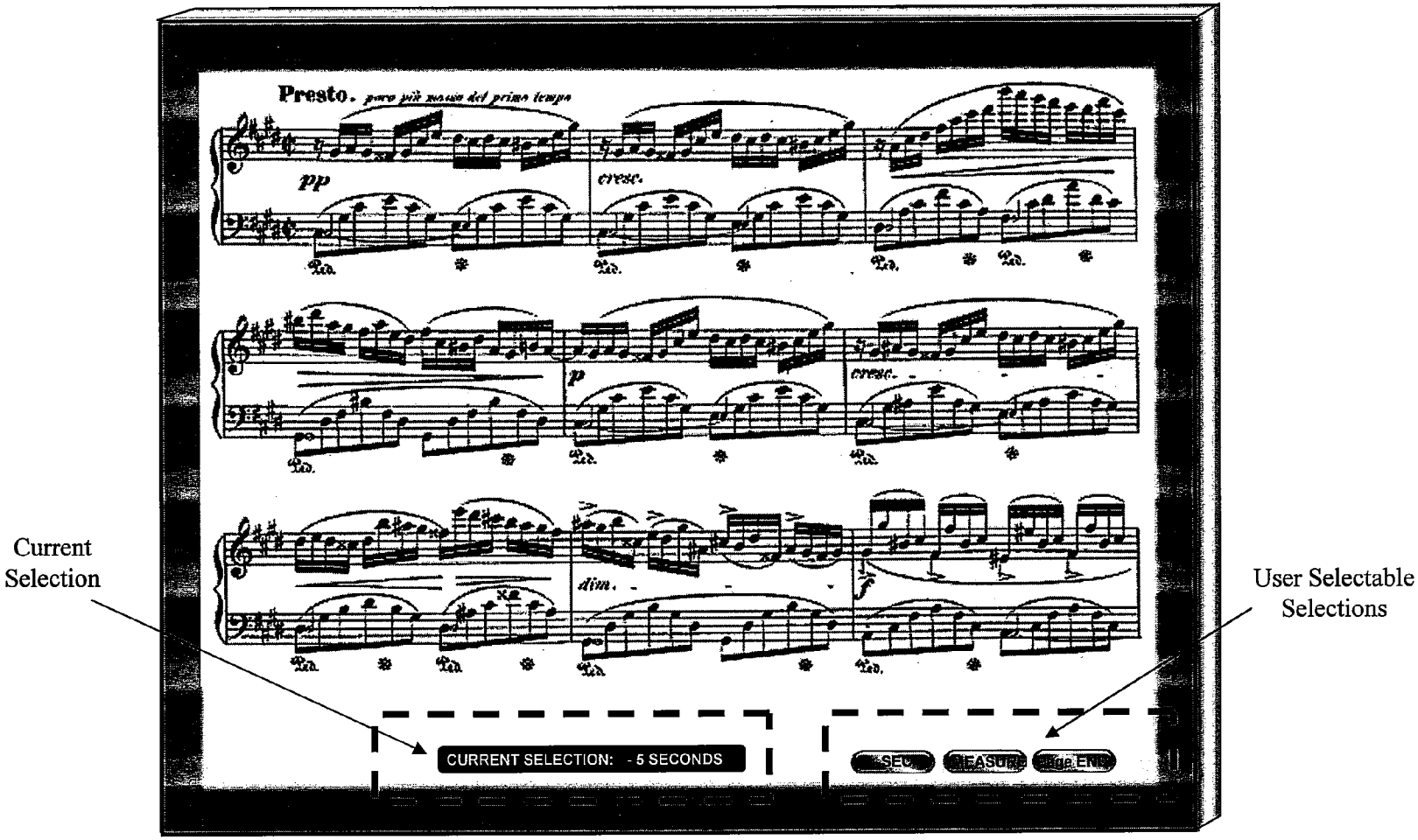
FIGS. 2A and 2B provide an illustration of the display of the MDMDD described in connection with FIG. 1, in accordance with an embodiment of the invention.
Figure 2B:
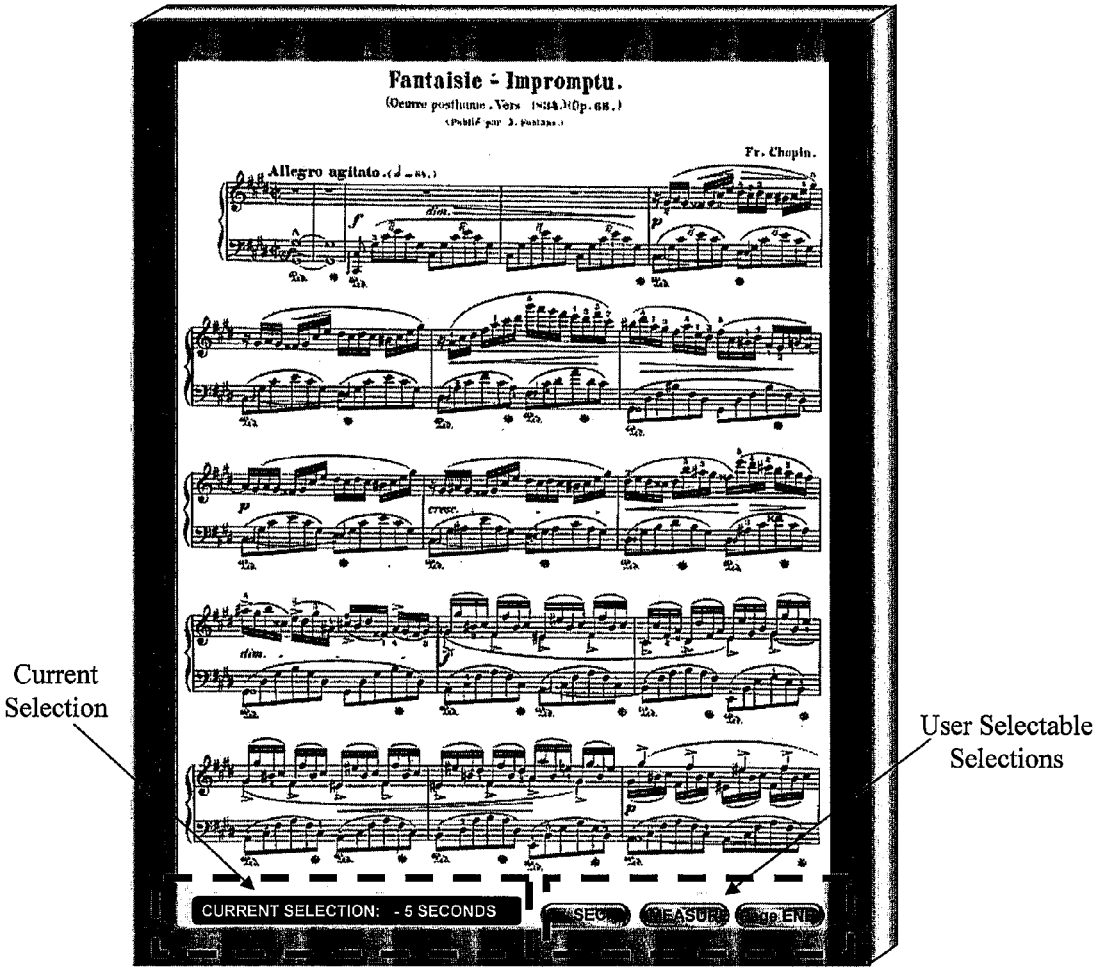

FIGS. 2A and 2B provide an illustration of the display of the MDMDD described in connection with FIG. 1, in accordance with an embodiment of the invention. As shown, the display comprises a touchscreen pad by which a user may view one or more bars of music. FIG. 2A provides an illustration of the MDMDD in which the bars of music are displayed in a landscape presentation while FIG. 2B provides an illustration of the MDMDD in which the bars of music are displayed in a portrait presentation. A user may appropriately configure the MDMDD to present in either the landscape or portrait format. FIGS. 2A and 2B illustrate a tablet or touchpad computer used to implement a MDMDD, for example. In addition to displaying the bars of music, the display of the MDMDD may also provide a graphical user interface in which one or more selections may be presented to and configured by a user. The selections, for example, may allow a user to configure the MDMDD to suit his preferences when a particular algorithm is employed. FIGS. 2A and 2B illustrate three possible selections for configuring when a successive page is to be displayed. In this representative embodiment, the user may determine how he wishes to flip or turn to the next page by way of choosing from a number of selections: 1) seconds before the end of the current page, 2) a number of measures before the end of the current page, or 3) right at the end of the current page. Also displayed on the lower left side of the display is an indication of the current setting used by the MDMDD. The current setting indicates that the displayed page will turn to the next page 5 seconds before reaching the end of the displayed page. In the representative embodiment shown, the number of seconds that elapses before a page is turned or flipped, for example, may be set by the number of times the "-sec" button is touched. For example, for each tap or touch of the "-sec" button located on the right hand side of the displayed page, the value for the number of seconds is incremented by one. The graphical user interface may be adapted for displaying any number of touchscreen capable selections and is not limited in scope to the illustrations presented in FIGS. 2A and 2B.

The multifunctional digital music display device (MDMDD) described in connection with FIGS. 1, 2A, and 2B may be adapted to take on a number of different form factors. The MDMDD may comprise any type of computing device, such as a tablet computer, or a laptop computer. In a representative embodiment, the form factor of a MDMDD may resemble that of a digital picture frame. The display in each of these types of devices may be used to present pages of music to a musician. The display may provide a touch sensitive screen capable of allowing a user to input one or more selections and/or input one or more commands.

Figure 3A:
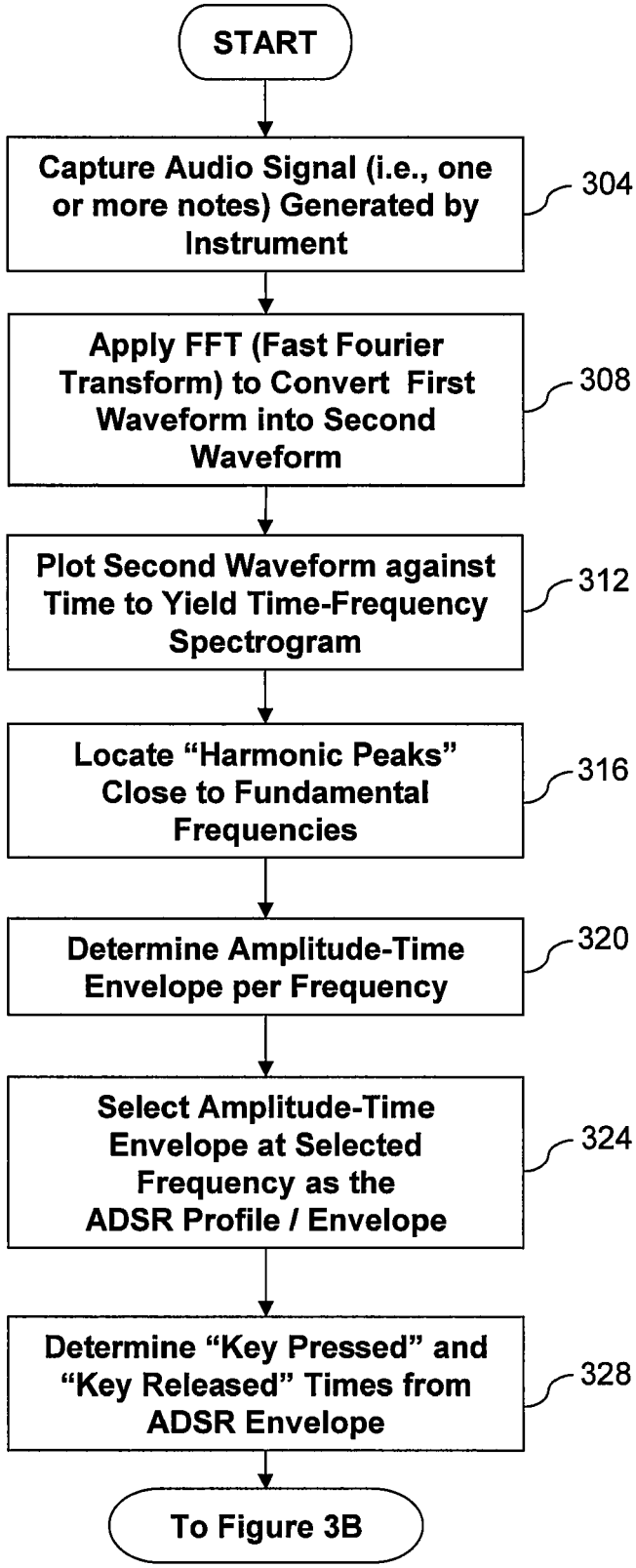
FIGS. 3A and 3B provide an operational flow diagram describing the construction of one or more ADSR envelopes or profiles of one or more notes generated by a musical instrument, in accordance with an embodiment of the invention.
Figure 3B:
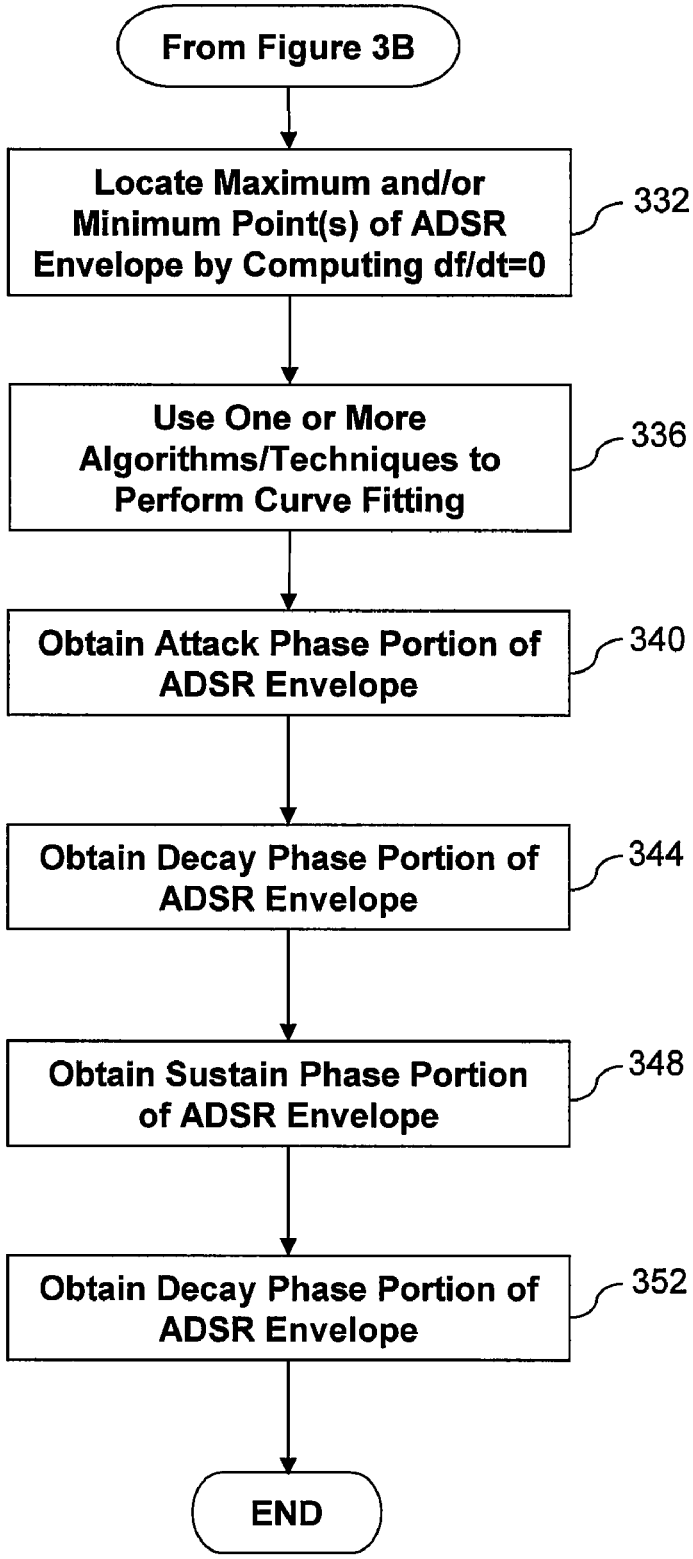

FIGS. 3A and 3B provide an operational flow diagram describing the construction of one or more ADSR envelopes or profiles of one or more notes generated by a musical instrument, in accordance with an embodiment of the invention. At step 304, an audio signal generated by an instrument is captured by the multifunctional digital music display device (MDMDD). The MDMDD may use the microphone previously described in connection with FIG. 1. The microphone converts the audio signal into an electrical signal. The audio signal received by the MDMDD may comprise a plurality of notes produced by a musical instrument. The musical instrument may comprise any type of sound producing device. For example, the musical instrument may comprise a stringed instrument (e.g., violin) or a woodwind instrument (e.g., saxophone), for example. The captured audio signal is converted into a first waveform that is a function of time. A user of the MDMDD may optionally input the type of instrument (e.g., saxophone, piano, trumpet, etc.) that the MDMDD will monitor. This allows the MDMDD to calibrate itself to the instrument that is being played. Next, at step 308, a Fast Fourier Transform (FFT) may be applied to the first waveform to convert it into a second waveform in the frequency domain. The second waveform is a function of frequency. At step 312, the second waveform is plotted as a function of time to yield a three-dimensional time-frequency spectrogram. Next, at step 316, one or more harmonic peaks are scanned and located over time. The scanning process may be implemented by way of using one or more algorithms employed by the MDMDD. The one or more algorithms may comprise a "window function" such as a Gaussian or Blackman window function. These functions may be used to mitigate noise and improve the plots of the time-frequency spectrogram. The one or more harmonic peaks may be close to the fundamental frequency of the note whose ADSR envelope is to be determined. Thereafter, at step 320, plots of amplitude over time per frequency are determined and analyzed. Then, at step 324, a frequency is selected at which an ADSR envelope or profile is to be used. Thus, the ADSR envelope or profile is obtained for the selected frequency corresponding to the note that is played by the instrument. At step 328, "Key Pressed" (i.e., beginning of an attack phase) and "Key Released" (i.e., end of a sustain phase) times may be easily determined from looking at the ADSR envelope/profile plot. The "Key Pressed" time may be interpreted as the time in which a musician begins playing a particular note using an instrument while the "Key Released" time may be interpreted as the time in which a musician terminates playing the particular note. When two or more notes are slurred or pedaled together, various extrapolation techniques may be used in constructing the ADSR envelope or profile of each of the slurred or pedaled notes in regions where the notes overlap. For example, when two notes are slurred, the first note's release phase may partially overlap with the second note's attack phase. In constructing the release and attack phases of the ADSR envelopes of slurred or pedaled notes, various extrapolation techniques may be used in conjunction with the "Key Pressed" and "Key Released" times. The process continues at step 332, at which one or more maximum and/or minimum points are determined by way of computing df/dt=0 (i.e., taking the first derivative of an amplitude over time plot at the selected frequency). Given the "Key Pressed" and "Key Released" points, various curve fitting or extrapolation algorithms/techniques may be employed to construct the desired ADSR envelope or profile. Next, at step 336, one or more curve fitting algorithms/techniques are employed in constructing an ADSR envelope or profile. In a representative embodiment, a minimum point corresponding to the beginning of the attack phase is connected to a maximum point corresponding to the end of the attack phase. This curve fitting algorithm/technique employs a simple connection between successive points. In a representative embodiment, an average slope may be computed by determining the first derivative over successive points along the amplitude over time plot. The first derivatives are averaged to yield an average slope. This average slope is used to extrapolate a portion of the ADSR envelope from a maximum or minimum point. For even more accuracy, it is contemplated that regression analysis, for example, and/or other curve fitting and/or extrapolation techniques may be used to generate the ADSR envelope. At step 340, the attack phase portion of an ADSR envelope is obtained using one or more of the previously mentioned algorithms/techniques. At step 344, the decay phase portion of the ADSR envelope is obtained using one or more of the previously mentioned algorithms/techniques. At step 348, the sustain portion of the ADSR envelope is obtained using one or more of the previously mentioned algorithms/techniques. The process ends at step 352, at which the release portion of the ADSR envelope is obtained using one or more of the previously mentioned algorithms/techniques.

Figure 4:
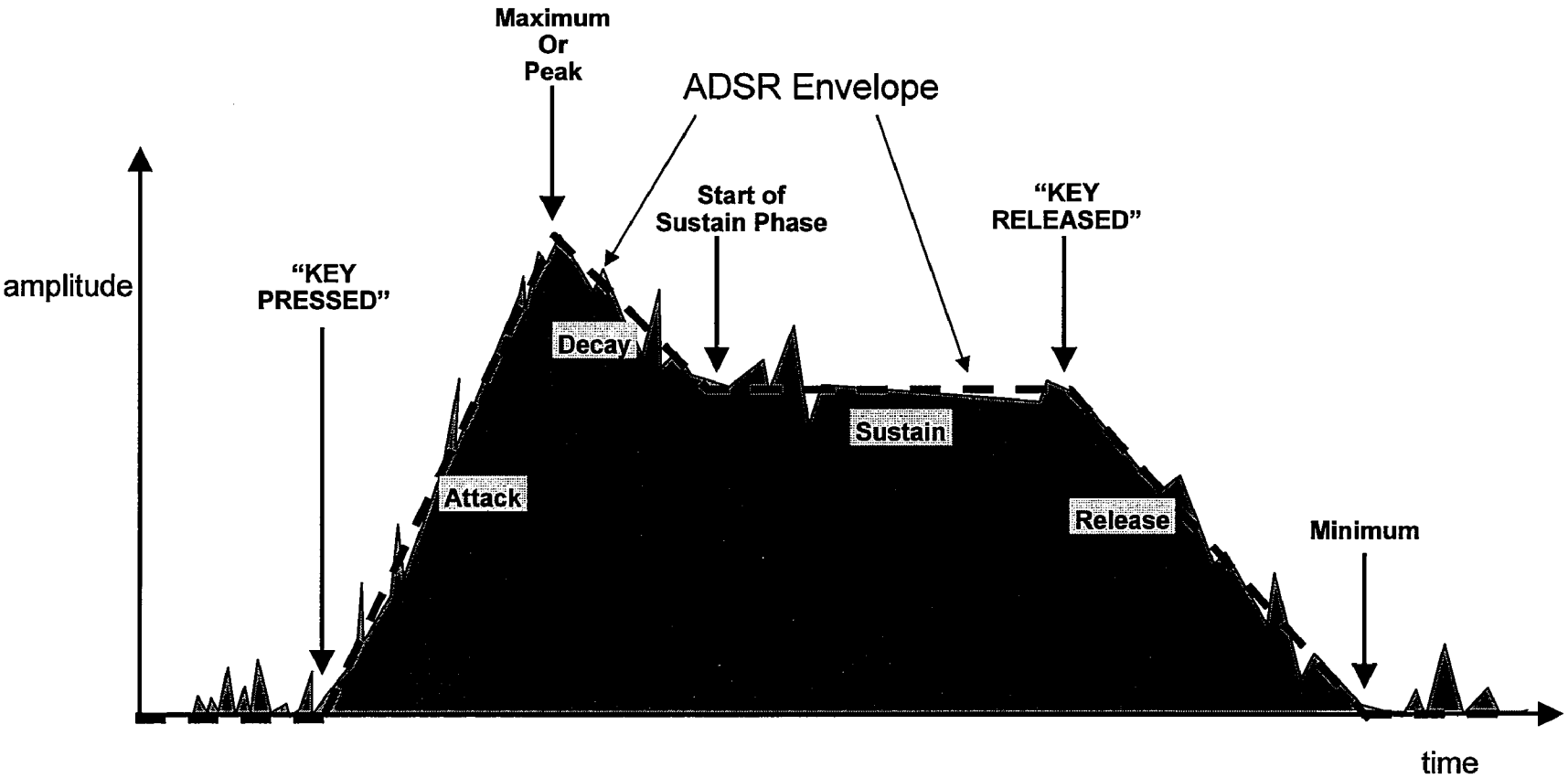
FIG. 4 is diagram illustrating the various portions of an ADSR envelope or profile in accordance with an embodiment of the invention.

FIG. 4 is diagram illustrating the various portions of an ADSR envelope or profile in accordance with an embodiment of the invention. The attack phase portion of the ADSR envelope is located between the "Key Pressed" point and the maximum point, as shown. A line connecting these two points is used, in this example, to approximate the attack phase. The decay phase portion of the ADSR envelope may be approximated by curve fitting between the peak (or maximum point) and the beginning of the sustain phase, as shown. The sustain phase may be identified as the portion of the ADSR envelope having a zero or close to zero first derivative value (i.e., the approximately flat portion). For example, a line connecting the peak and the start of the sustain phase may be used to approximate the decay phase. The sustain phase portion of the ADSR envelope ends at the beginning of the release phase or at the "Key Released" point, as shown. The release phase portion of the ADSR envelope is located between the "Key Released" point and a minimum point, as shown. A line connecting these two points approximates the release phase. The curve fitting algorithms/techniques mentioned in connection with FIG. 3, may be programmed to generate a negatively sloping curve after an attack or a sustain phase. The curve fitting algorithms/techniques may be programmed such that curve plotting takes into consideration that the decay phase amplitude does not reach zero amplitude and is followed by a sustain phase which has a relatively flat curve (i.e., approximately zero slope) of non-zero amplitude. The curve fitting algorithms/techniques may be programmed to take into consideration that the release phase will become 0 or very close to 0 if the note is not affected by a successive overlapping note. The sustain phase has a slope approximately equal to 0 (i.e., df/dt=0) and has a non-zero amplitude over a period of time that is characteristic of the instrument used.

In the event slurring of a plurality of notes occurs or pedaling of a plurality of notes occurs (i.e., when using a piano), a release phase of a first note may overlap with an attack phase of a succeeding note. Because of this overlap, the MDMDD may employ one or more algorithms/techniques to reconstruct the release phase of the ADSR envelope of the first note and the attack phase of the ADSR envelope of the second note. The one or more algorithms/techniques used in this reconstruction may employ the ADSR curve fitting extrapolation algorithms/techniques previously described in connection with FIG. 3. These include plotting a line that connects a minimum (or maximum) point to a maximum (or minimum) point, computation of an average slope using a plurality of points between a minimum (or maximum) point to a maximum (or minimum) point and using the average slope to extrapolate from one of the points, and using regression analysis and other curve fitting/extrapolation algorithms. By using such curve fitting algorithms/techniques, either a release phase or an attack phase may be extrapolated, thereby yielding an ADSR envelope plot of each and every note when a plurality of notes are slurred or pedaled.

Figures 5A, 5B:
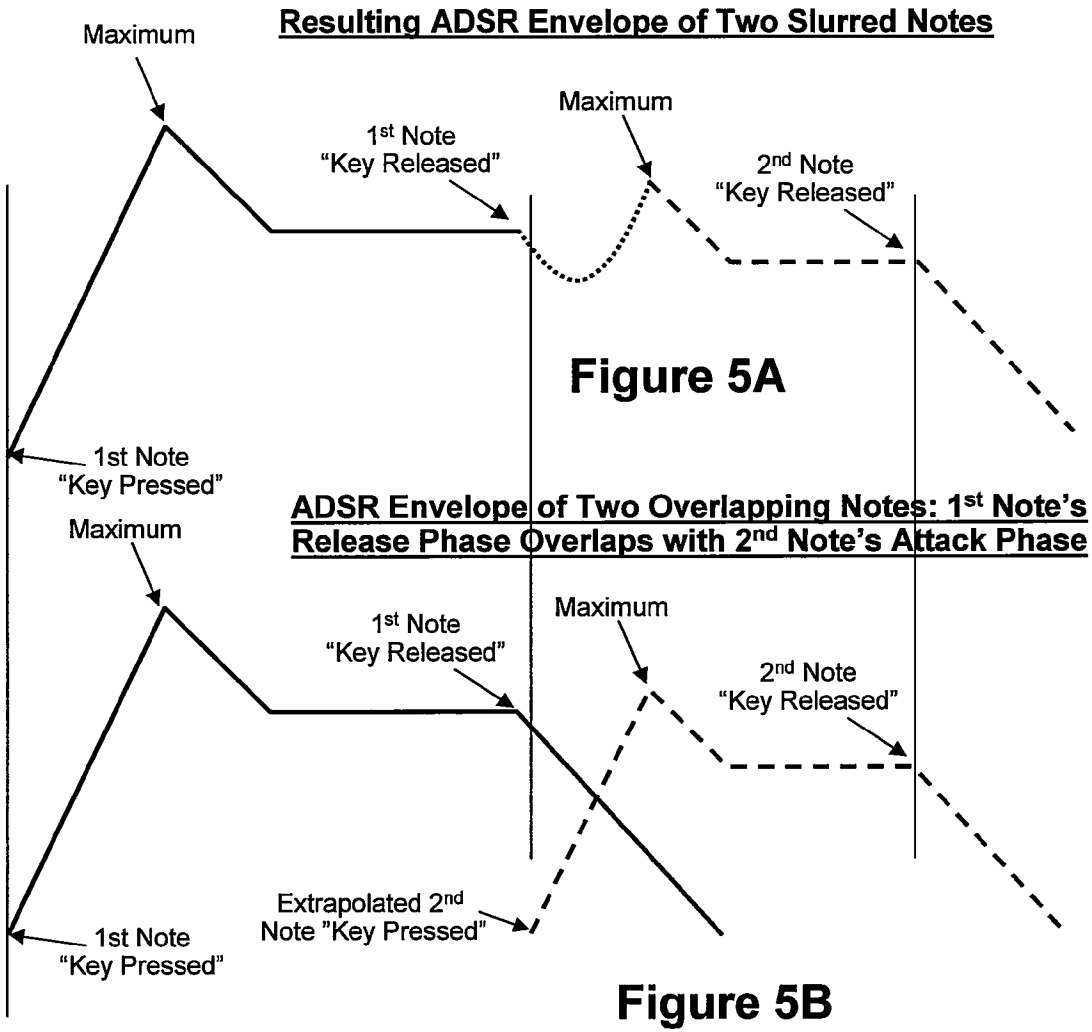
FIG. 5A illustrates a typical ADSR envelope of two slurred notes.
FIG. 5B illustrates how two ADSR envelopes may be extrapolated from a typical ADSR envelope of two slurred notes, in accordance with an embodiment of the invention.

FIG. 5A illustrates a typical ADSR envelope of two slurred notes. A first note is indicated using a solid line while a second note is indicated using a dotted line. The ADSR envelope shown may be generated from a woodwind instrument, for example. The time in which a first note is initiated by a musician is indicated as "$1^{st}$ note Key Pressed" while the time in which the musician terminates playing the $1^{st}$ note is indicated as "$1^{st}$ note Key Released". Likewise, the time in which the musician terminates playing the second note is indicated as "$2^{nd}$ note Key Released".

FIG. 5B illustrates how two ADSR envelopes may be extrapolated from a typical ADSR envelope of two slurred notes, in accordance with an embodiment of the invention. The first note is indicated using a solid line while the second note is indicated using a dotted line. As shown, the release phase of the ADSR envelope of the first note and the attack phase of the ADSR envelope of the second note is extrapolated. The extrapolation may be accomplished using the curve fitting algorithms/techniques previously described in connection with FIG. 3, for example.

Figure 6:
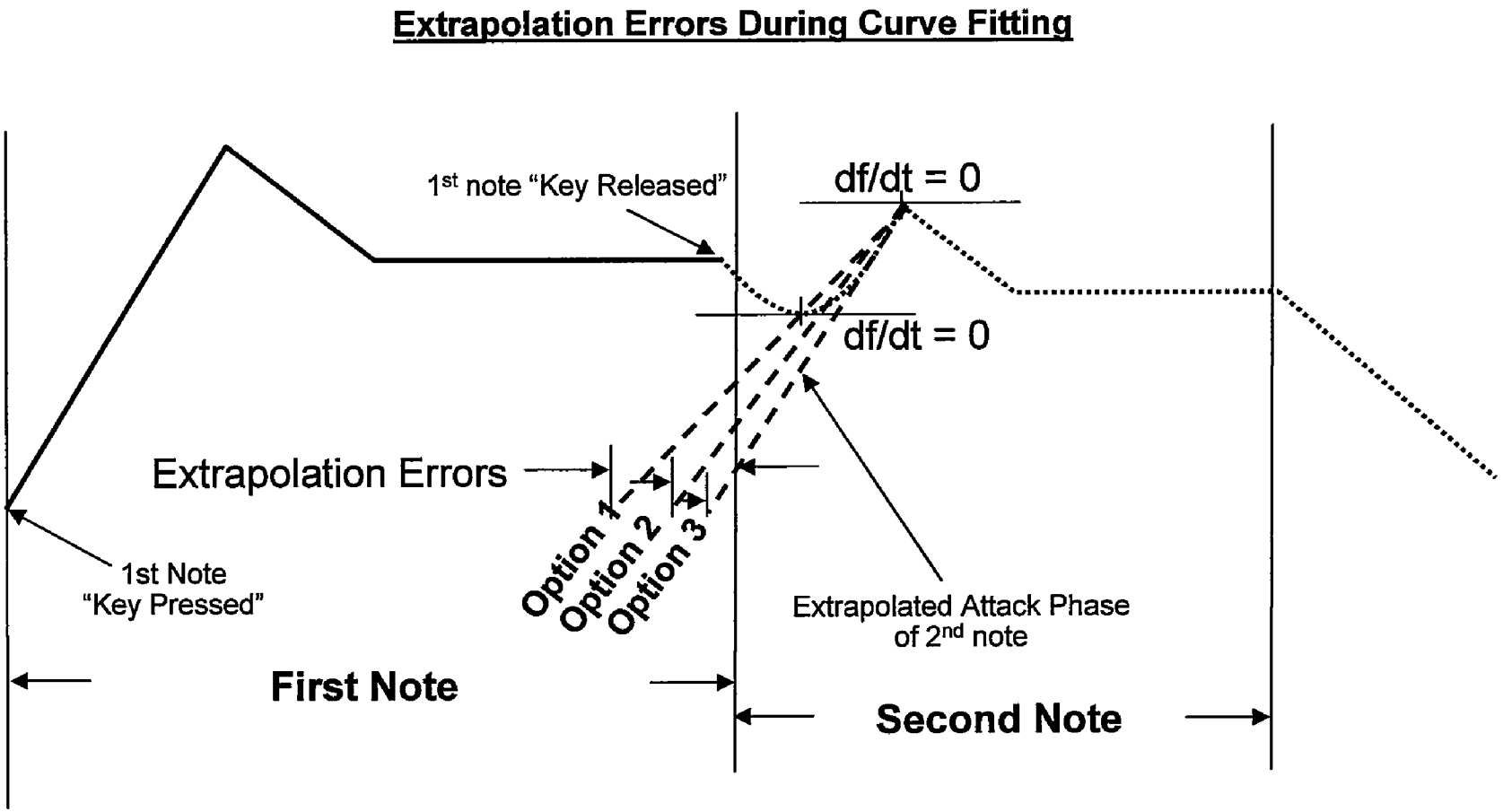
FIG. 6 illustrates extrapolation of an attack phase of an ADSR envelope of a second note of the two slurred notes described in connection with FIGS. 5A and 5B, in accordance with an embodiment of the invention.

FIG. 6 illustrates extrapolation of an attack phase of an ADSR envelope of a second note of the two slurred notes described in connection with FIGS. 5A and 5B, in accordance with an embodiment of the invention. As shown, a minimum point and maximum point is located on the ADSR envelope of the second note. The minimum and maximum points may be determined by application of the first derivative to the second note portion of the ADSR envelope. The extrapolation may be accomplished using a plurality of options. Shown in FIG. 6 are three options. With respect to Option 1, the attack phase of the ADSR envelope of the second note may be obtained by simply connecting the minimum point to the maximum point using a straight line. This option usually yields the highest extrapolation error. Option 2 utilizes an average slope algorithm over the positive slope portion of the slurred portion of the two notes. Option 2 may provide better accuracy than Option 1. Option 3 utilizes regression analysis and curve fitting to extrapolate the attack phase of the ADSR envelope for the second note. Option 3 usually provides the best accuracy among the three options. Although not described, the principles used to extrapolate the attack phase of the second note may also be used to extrapolate the release phase of the first note.

Figure 7:
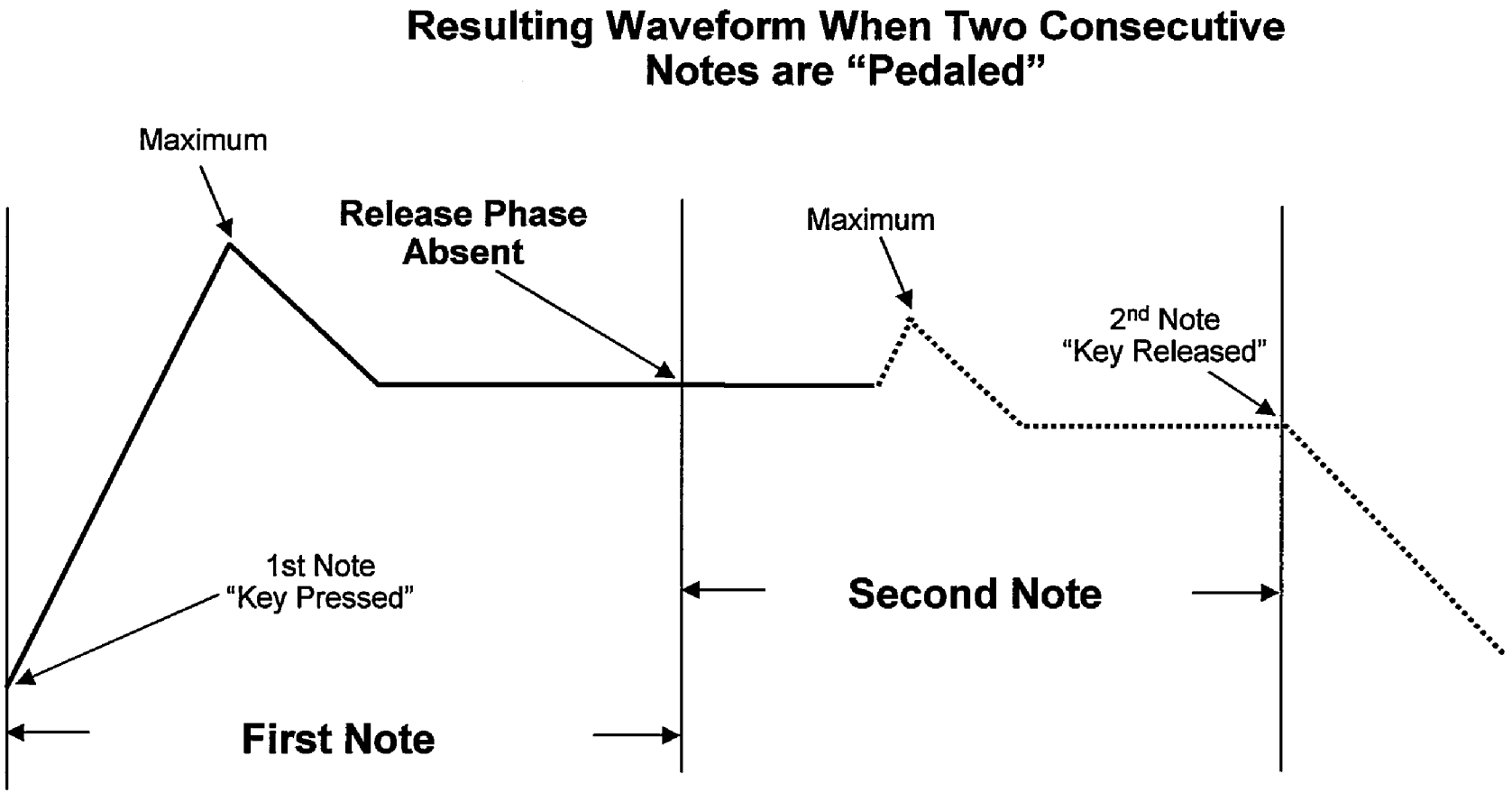
FIG. 7 illustrates a typical ADSR envelope of two pedaled notes.

FIG. 7 illustrates a typical ADSR envelope of two pedaled notes. A pianist playing a piano, for example, may generate the pedaled notes. A first note is indicated using a solid line while a second note is indicated using a dotted line. The pedaled portion of the two notes may also be indicated as a solid line. The time in which a musician initiates a first note is indicated as "$1^{st}$ note Key Pressed". Unlike when two notes are slurred, a release phase is absent for the first note when two notes are pedaled. Although not shown, one may utilize the same curve fitting algorithms/techniques previously described in connection with FIG. 3, the ADSR envelope of the first note as well as the ADSR envelope of the second note may be extrapolated.

In accordance with the various aspects of the invention, the MDMDD may be used to automatically flip or turn pages of music as a musician plays his instrument. The MDMDD turns pages of music by way of using the ADSR profile of each note played by a musician. After receiving and analyzing the audio provided by an instrument, the ADSR envelopes or profiles are constructed to determine what notes are played by the musician, the MDMDD then compares the notes played by the instrument to music stored in digital music files. As previously mentioned in connection with FIG. 1, the data files (e.g., digital or digitized music files) may be stored in either an internal storage device or a removable storage device. The removable storage device may comprise a compact flash card, for example. These data files may be referenced by the MDMDD for tracking and comparing the notes generated by an instrument with ideal notes that are referenced by the data files. The data files may comprise a MIDI SMF or XMF file, for example, that corresponds to the musical piece or composition played by the musician. By comparing each detected note with the data files stored in memory, the MDMDD is able to track and monitor the current location within the musical composition. The process by which the next page of music is displayed is determined by one or more inputs provided by the musician. The musician may choose to "flip to the next page" based on: (a) a number of seconds before reaching the end of the page, (b) a number of measures before reaching the end of the page, or (c) when reaching the end of the page, for example. The MDMDD may also flip to the next page by way of manually pressing a button or by way of touching a button provided by a graphical user interface. Alternatively, the MDMDD may advance to the next page or go back to a previous page by way of manual control by the user. The musician, for example, may use his foot to select a page by pressing an electronic foot pedal connected to the MDMDD. By depressing the foot pedal a number of consecutive times, a user may be able to input the number of pages skipped before the desired page is displayed. As previously described in connection with the representative embodiments illustrated in FIGS. 2A and 2B, an exemplary three possible selections for determining when to turn to a successive page may be provided to the musician. In this representative embodiment, the musician may determine how he wishes to flip or turn to the next page by way of choosing from the following selections: 1) seconds before the end of the current page, 2) a number of measures before the end of the current page, or 3) right at the end of the current page. Also displayed on the lower left side of the display is an indication of the current setting used by the MDMDD. When assessing when to turn to the next page of music, the MDMDD may perform an error tolerance analysis and/or statistical analysis to more accurately assess if it is the right time to turn to the next page. For example, the software code in the memory of an MDMDD may be programmed to determine whether a note received by the MDMDD was played erroneously by the musician. If, for example, a note was played erroneously by the musician, the note will not affect the MDMDD's temporal tracking of the music being played. If, for example, a number of errors are successively made, the MDMDD may utilize an error tolerance to determine whether to search for other portions of music that correlate well with what has been played. For example, the error tolerance may be set to a level corresponding to a certain number of errors. Should the error tolerance exceed this level, the MDMDD may be configured to search the music to determine the location in which the musician is currently playing. The correlation may employ using a certain number of measures or beats previously played by the musician, for example. The number of measures or beats to be used in this correlation may be configured or set by a user of the MDMDD. If there is a high correlation, the MDMDD may jump to that particular location of music. In determining the current location of a musician who is playing a musical composition/piece, the MDMDD may compare the "Key Pressed" and "Key Released" times of an ADSR envelope of each note to a reference data file. The reference data file may comprise a musical score of the piece being played by the musician. The reference data file may be used to compare and contrast various parameters of an ADSR envelope with respect to one or more factors. Such factors include the timing and the duration of the notes played by the musician. The reference data file may comprise sheet music (i.e., a score) corresponding to a number of different instruments. The reference data file may also provide correct tonal or pitch information of all the notes that are played by the musician. Fundamental frequency analysis that is performed by the MDMDD during ADSR envelope construction may also be used along with the information provided by the reference data file to determine if the musician has played the wrong note. While playing a piano, for example, the MDMDD may check to see how many other notes in a particular chord are correct in its decision making process. The MDMDD may also be configured by the musician to tolerate some inaccuracies with respect to "Key Pressed" time and "Key Released" time of a received note or even a slight drift from the nominal fundamental frequency of the received note. The MDMDD may perform statistical analysis by storing historical data of notes previously played as an aid to its decision making process. It may do this by comparing these notes to the music found in the reference data file. It may, for example, look at the notes already played in the same or previous measures to help determine the current position or location in the musical composition or piece being played. The MDMDD may also compare suspected wrong notes to the intended keys to ascertain if the musician made an error. The MDMDD may use the timing and/or cadence of previously played notes (and measures) to determine if the notes generated by an instrument progresses as expected even if some of the notes were skipped or incorrectly played.

In accordance with the various aspects of the invention, the MDMDD may act as an "intelligent metronome" by tracking the notes that were played by a musician and correlating this information with a reference data file stored within the MDMDD. The data file may comprise a MIDI file, for example, that corresponds to the musical piece or composition played by the musician. When functioning as an intelligent metronome, the MDMDD uses the data file as a reference for comparing the sound (i.e., notes) received from the instrument. The MDMDD may be used to assess the temporal accuracy of each and every note played. Various aspects of the invention provide a metronome that is able to vary its cadence or tempo based on one or more different "timing signatures" encountered within a score or musical composition. The MDMDD may generate an audible sound (i.e., a beat) using its speaker. The volume of the sound may be varied by the musician. The MDMDD may also exhibit a flashing light that is synchronized to the beat it produces. The MDMDD may also provide a correct interpretation of the tempo based on what is written in one or more referenced data files. The referenced data files may comprise digital scores of one or more musical pieces. The MDMDD takes into consideration the time signature as well as other markings or indications written in the music to determine changes in tempo throughout the score or musical composition. Furthermore, the intelligent metronome functionality of the MDMDD may also generate one or more cadences or tempos based on the musician's preferences. For example, a pianist may play a melody in which his left hand plays with a different tempo compared to his right hand, due to a different number of notes in the left-hand beat compared to the right-hand beat. In this instance, the MDMDD will process the left hand portion of the music separately from the right hand portion of the music to determine the two different cadences. In a representative embodiment, the MDMDD may provide one of two metronome beats as it monitors and processes the notes received from the piano while correlating the notes with the reference data files. The musician may control which of the two possible beats he desires by inputting a selection into the MDMDD. The various techniques/algorithms employed while the MDMDD acts as an "intelligent metronome" may be applied when the MDMDD is used to automatically flip or turn pages of music. In the event an instrument (e.g., a piano) utilizes more than one clef, the MDMDD may correlate the progress of the musician with respect to each clef. In this manner, the MDMDD may cross-check and/or correlate between the two cadences.

In accordance with the various aspects of the invention, the MDMDD may be used to alert and correct an out-of tune instrument. In a first operational mode, the MDMDD may collect the temporal and/or harmonics composition statistics while a musician is playing, and may provide an alert during a performance or provide a report when requested, for example. In a second operational mode, the musician may use the MDMDD to perform a manual test, on a note by note basis, of each note capable of being generated by the instrument. In either mode, the MDMDD may alert the musician if the instrument needs tuning based on one or more conditions.

In a representative embodiment, nominal ADSR envelopes/profiles, fundamental frequencies, and harmonic frequencies for each fundamental frequency, are stored in a memory or storage device of the MDMDD and are used as references when determining if a note is out-of-tune. In a representative embodiment, a "baselining" process is used to calibrate or initialize the MDMDD immediately after the user has tuned the instrument. This calibration or initialization procedure is used to store notes generated by a perfectly tuned instrument into the MDMDD. This would occur, for example, right after an instrument is professionally tuned. The musician may set the MDMDD such that it records a number of notes right after tuning has been performed, allowing calibration or initialization of the MDMDD to take place. The musician may calibrate the MDMDD by playing each tuned note with differing note durations (e.g., ½, ¼th, ⅛th, 1/16th, 1/32nd), and with differing dynamics. The notes may be varied by incorporating the following musical characteristics: slur, tie, staccato, tenuto, pedaling (if possible), such that the MDMDD can create a complete ADSR envelope and frequency harmonics composition database. This database may be referred to as a stored reference database that includes all notes capable of being generated by the instrument. The MDMDD may alert the musician a) if the fundamental frequency determined by the MDMDD is substantially different (i.e., exceeds a particular threshold, for example) from the expected frequency or the calibration frequency used during the baselining process, b) if ADSR envelope or profile is substantially different (i.e., exceeds a particular threshold) from what is expected, and c) if the composition of the frequency harmonics determined from the FFT and spectral analysis phase of the ADSR envelope construction is substantially different (i.e., one or more of the frequency harmonics exceeds or is less than corresponding thresholds) from the composition recorded during the baselining process. In another representative embodiment, the MDMDD may be pre-configured with the fundamental frequency and typical ADSR envelopes/profiles for each note generated by one or more instruments. If the MDMDD deems that the difference between the fundamental frequency (of the note played by the musician) and its expected frequency is beyond a particular threshold, the MDMDD may alert the musician by way of its display or by way of its speaker, for example.

When the MDMDD operates in tuning alert mode, the MDMDD utilizes the process described in connection with the ADSR envelope construction described in the operational flow diagram of FIG. 3. The MDMDD compares the (a) fundamental frequency, (b) constructed ADSR envelope or profile and (c) optionally, the harmonic frequency composition of each note to the stored reference database to measure whether each note has drifted out of appropriate tolerance levels. As previously mentioned, the MDMDD may operate under two modes. The first mode may be termed a "Tuning Check" mode wherein a musician or user plays and checks each note individually. The second mode may be termed an "On-The-Fly" mode wherein the MDMDD monitors constructed ADSR envelopes on a real-time basis. By way of acquiring statistical data over time, the MDMDD is able to accurately assess that one or more notes are out-of-tune or have incorrect ADSR profiles and/or incorrect frequency harmonics. When a determination is made based on this statistical data, the MDMDD may either alert the user or store the alert in memory for future reference.

In accordance with the various aspects of the invention, the MDMDD may be used to detect and perform statistical analysis of one or more musical errors that a musician makes while playing an instrument. The errors comprise tonal and temporal errors that the musician makes during a practice or recital, for example. The errors may be stored in a database and statistically interpreted so that a student musician and his music teacher may focus on a problem and effectively fix the problem. In a representative embodiment, the primary goal of performing statistical analysis may be to detect incorrect or missing notes. In another embodiment, the goal of statistical analysis allows better detection of starting or ending a note at the wrong time or pedaling too early or too late. In a representative embodiment, various error indicators may be displayed along with the music to a musician by way of the display of the MDMDD. Incorrect or missing notes may be indicated using any type of symbol placed above the affected note in the displayed music. Pedaling early or late indicators may also be placed in a location above the affected note(s). The errors may be reported to the musician using the MDMDD's display by type of error. Furthermore, the MDMMD may be configure such that one or more errors may be reported to the musician at any time should the musician input a particular request or command into the MDMDD, for example. By way of using statistics provided by the MDMDD, the musician and his instructor are better able to monitor and measure the musician's progress.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of displaying pages of music to a musician playing an instrument, said method comprising:

constructing an ADSR envelope for each note played by said musician;

comparing one or more parameters of said ADSR envelope to one or more corresponding reference parameters; and displaying a next page of said music when a particular temporal location is reached within a current page of said music, wherein said temporal location is determined by using:

error tolerances to assess if one or more notes were skipped or incorrectly played; and statistical analysis for correlating what has been previously played against reference music data files, wherein said error tolerance is based on reaching a level corresponding to a certain number of successive errors.

2. The method of claim 1 wherein said correlating is used over a certain number of measures if said certain number of successive errors is reached.

3. The method of claim 1 wherein said correlating is used over a certain number of beats previously played by said musician if said certain number of successive errors is reached.

4. The method of claim 1 wherein said correlating compares a first time corresponding to the start of each said note to a second time corresponding to the start of a corresponding note stored in a reference data file and a third time corresponding to a release point of each said note to a fourth time corresponding to the release point of said corresponding note stored in said reference data file, said first and said third times obtained from said ADSR envelope.

5. The method of claim 4 wherein said reference data file comprises a musical score corresponding to a number of different instruments.

6. The method of claim 1 wherein said correlating checks to see how many other notes in a particular chord are correct.

7. The method of claim 1 wherein said correlating uses the cadence of previously played notes generated by said instrument.

8. A system for displaying pages of music to a musician playing an instrument, said system comprising:

a memory storing a software code; and a processor for executing said software code, wherein said executing performs:

constructing an ADSR envelope for each note played by said musician;

comparing one or more parameters of said ADSR envelope to one or more corresponding reference parameters; and displaying a next page of said music when a particular temporal location is reached within a current page of said music, wherein said temporal location is determined by using:

error tolerances to assess if one or more notes were skipped or incorrectly played; and statistical analysis for correlating what has been previously played against reference music data files, wherein said error tolerance is based on reaching a level corresponding to a certain number of successive errors.

9. The system of claim 8 wherein said correlating is used over a certain number of measures if said certain number of successive errors is reached.

10. The system of claim 8 wherein said correlating is used over a certain number of beats previously played by said musician if said certain number of successive errors is reached.

11. The system of claim 8 wherein said correlating compares a first time corresponding to the start of each said note to a second time corresponding to the start of a corresponding note stored in a reference data file and a third time corresponding to a release point of each said note to a fourth time corresponding to the release point of said corresponding note stored in said reference data file, said first and said third times obtained from said ADSR envelope.

12. The system of claim 11 wherein said reference data file comprises a musical score corresponding to a number of different instruments.

13. The system of claim 8 wherein said correlating checks to see how many other notes in a particular chord are correct.

14. The system of claim 8 wherein said correlating uses the cadence of previously played notes generated by said instrument.

* * * * *